United States Patent [19]

Oliver

[11] Patent Number: 4,591,008

[45] Date of Patent: May 27, 1986

[54] LUBE RESERVOIR PROTECTION FOR ROCK BITS

[75] Inventor: Michael S. Oliver, Lafayette, La.

[73] Assignee: Smith International, Inc., Newport Beach, Calif.

[21] Appl. No.: 643,220

[22] Filed: Aug. 22, 1984

[51] Int. Cl.[4] ..... E21B 9/10; E21B 10/22; E21B 10/14

[52] U.S. Cl. ..... 175/227; 175/337; 175/374

[58] Field of Search ..... 175/227, 228, 229, 337, 175/371, 374, 327, 329

[56] References Cited

U.S. PATENT DOCUMENTS

| | | | |
|---|---|---|---|
| 3,130,801 | 4/1964 | Schumacher, Jr. | 175/374 |
| 3,134,447 | 5/1964 | McElya et al. | 175/374 X |
| 3,513,728 | 5/1970 | Hudson et al. | 76/108 R |
| 4,055,225 | 10/1977 | Millsapps | 175/228 |
| 4,140,189 | 2/1979 | Garner | 175/329 |
| 4,343,371 | 8/1982 | Baker, III et al. | 175/374 X |
| 4,359,113 | 11/1982 | Morris | 175/337 |
| 4,421,184 | 12/1983 | Mullins | 175/337 |

*Primary Examiner*—John M. Jillions
*Assistant Examiner*—Thomas R. Hannon
*Attorney, Agent, or Firm*—Robert G. Upton

[57] ABSTRACT

This invention discloses a method to protect the lubrication reservoir system for sealed bearing rotary cone rock bits. A multiplicity of flush-type tungsten carbide inserts are positioned in each leg of the rock bit surrounding the lubrication reservoir cover cap. The inserts prevent erosion of the leg around the cover cap, thus protecting the snap ring that secures the cover cap within the reservoir chamber.

3 Claims, 3 Drawing Figures

LUBE RESERVOIR PROTECTION FOR ROCK BITS

BACKGROUND OF THE INVENTION

1. Field of the Invention

This invention relates to sealed bearing rotary cone rock bits having lubricant reservoir systems.

More particularly, this invention relates to sealed bearing rotary rock bits having lubricant reservoir systems that require protection from erosion during rotary cone rock bit boring operations.

2. Description of the Prior Art

It is well-known that rotary cone rock bits are subjected to extremely harsh conditions during earth boring operations. Each rock bit is subjected to hard formations, as well as the erosive effects of downhole hydraulics when the bits are run with drilling "mud". In addition, it is not uncommon for rotary cone rock bits to be subjected to drillstring weights of up to 40,000 pounds. Additionally, the cuttings resulting from the borehole drilling operation have an extremely abrasive quality and contribute to the erosion of the various parts of the rotary cone rock bit.

Drill bit manufacturers have therefore attempted to protect the drill bit while running in the aforementioned environment.

U.S. Pat. No. 3,130,801 utilizes a series of tungsten carbide inserts in the surface of the leg. The purpose of the inserts is to act as a reamer for the borehole to maintain the "gage" of the hole. The gage of the hole is the diameter of the hole as the bit works in an earth formation. Obviously, if the gage of the hole is allowed to become undersized, any new rock bit that follows a worn rock bit that has been removed from the hole will "pinch" as it is lowered into the hole, thereby causing premature failure of the new bit. This invention suggests using inserts near the shirttail portion of each leg of the three cone bit. The shirttail part of the leg is that portion of the leg nearest the borehole bottom and immediately adjacent the rotary cone rotatably secured to that particular leg. The invention teaches a means to maintain the gage of the borehole.

U.S. Pat. No. 3,513,728 describes yet another means to maintain the gage of a borehole. This particular patent deals with air bits; i.e., rock bits that utilize air as a means to flush detritus from the borehole bottom, as well as a means to cool and lubricate the bearings of the bit. This patent, like the foregoing '801 patent, utilizes a multiplicity of flush-type tungsten carbide inserts inserted in the shirttail portion of the leg immediately adjacent the rotary cone secured to that particular leg.

U.S. Pat. No. 4,140,189, assigned to the same assignee as the present patent application, describes a sealed bearing rotary cone rock bit and a means to maintain a gage of a borehole while the rock bit works in the earth formation. This patent utilizes a pair of tungsten carbide inserts that are interference fitted within the outside surface of each leg of the rock bit. This patent, however, differs from the two foregoing prior art patents in that each of the inserts extend well beyond the face of the leg of the rock bit. The inserts are preferably diamond-tipped tungsten carbide inserts that serve primarily to maintain the gage of the borehole.

The present invention goes beyond the state of the art in that a means is provided to protect the lubrication reservoir system in a sealed bearing rotary cone rock bit. A series of flush-type inserts are provided around the peripheral edge of the reservoir cavity or chamber to protect a cover cap for the reservoir system from becoming disengaged from the rock bit leg. The cover cap, for example, is retained within the reservoir system by a snap ring that is secured within an annular groove formed in an opening to the reservoir chamber formed by the leg of the rock bit. The unprotected leg could easily erode down to the retention snap ring groove near the opening to the reservoir, resulting in the loss of the cover cap as the rock bit works in the borehole. Obviously, loss of the cover cap means immediate loss of all lubricant for the rock bit bearings, hence early catastrophic failure of the bit occurs.

SUMMARY OF THE INVENTION

It is an object of this invention to provide a means to protect a cover cap for a lubricant reservoir formed by the leg of the rock bit to prevent the cover cap from ejection from the leg of the rock bit during drilling operations.

A means is disclosed to protect the lubrication system for a sealed bearing rotary cone rock bit. A rock bit body forms a first pin end and a second cutting end. One or more legs extend from the rock bit body. Each leg forms a journal bearing that extends obliquely toward an axis of the body. A rotary cutter cone is rotatively attached to the journal bearing. The lubrication system includes a lubricant reservoir chamber formed by each leg of the rock bit body. The reservoir chamber is closed out by a reservoir cover cap that is retained within an opening into the reservoir chamber formed by the leg of the rock bit. A means is provided to protect the cover cap for the reservoir chamber to prevent the cover cap from becoming disengaged from the lubricant reservoir chamber in each leg of the rock bit during rock bit drilling operations.

One or more flush-type tungsten carbide inserts are interference fitted within the leg of the rock bit adjacent the opening to the reservoir chamber formed in the rock bit. The flush-type inserts surround the opening to prevent erosion of the leg of the rock bit during rock bit operations, thus protecting the snap ring that is engaged with a groove formed in the leg of the rock bit adjacent the opening to the reservoir chamber. The snap ring retains the cover cap for the lubricant chamber.

An advantage then of the present invention over the prior art is the utilization of flush-type tungsten carbide inserts around the opening to the lubricant reservoir. The tungsten carbide inserts protect the cover cap closing out the reservoir and prevent the cover cap from being ejected from the leg of the rock bit through the erosive effects that occur during rock bit drilling operations.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
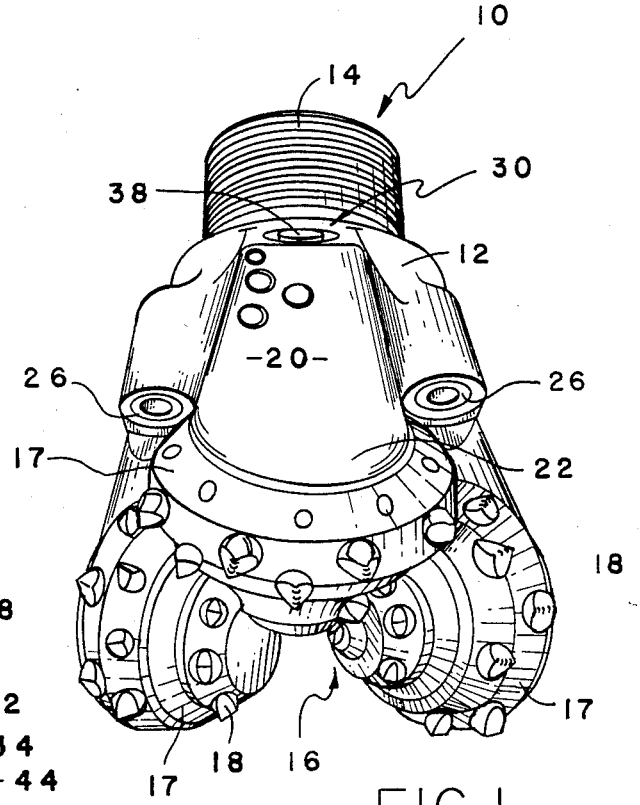
FIG. 1 is a perspective view of a typical three cone sealed bearing rock bit, each leg of the rock bit containing a lubricant reservoir system.

Referring now to FIG. 1, a sealed bearing rotary cone rock bit, generally designated as 10, consists of rock bit body 12, forming an upper pin end 14 and a cutting end, generally designated as 16. One or more cutter cones 17 comprise the cutting end 16, each of the cones being rotatively attached to legs 20 extending from bit body 12. Each of the cones 17 has, for example, a multiplicity of equidistantly spaced tungsten carbide inserts 18 interference fitted within the cone body 17. A grease reservoir system, generally designated as 30, is associated with each of the legs 20 of the rock bit 10. A shirttail 22 terminates the end of leg 20 and is immediately adjacent the rotatable cone 17. Hydraulic mud is routed through a drillstring (not shown) into pin end 14 and out through nozzles 26. The "mud" serves to lift detritus off the borehole bottom while, at the same time, cooling and cleaning the cutter cones as they work in a borehole.

Figure 2:
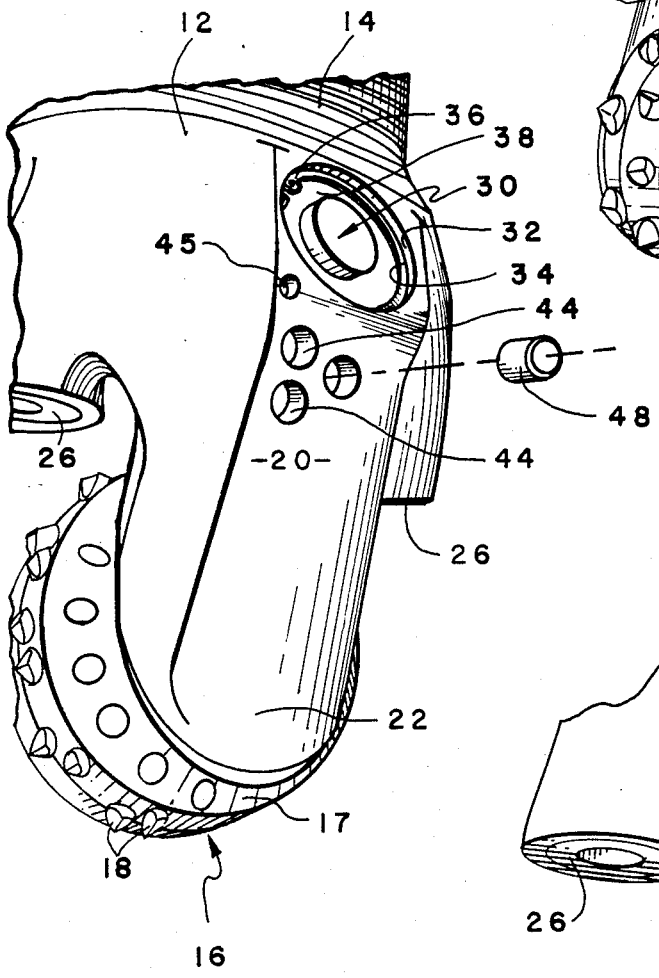
FIG. 2 is a partially cut away perspective view of one leg of a rock bit, illustrating a flush-type tungsten carbide insert exploded from its receptacle in the leg of the rock bit.

FIG. 2 illustrates one leg 20 of the rock bit 10. A grease reservoir 30 is located in each of the legs of the bit. The reservoir system comprises a reservoir cavity 32, a resilient boot (not shown) and a cover cap 38. The cover cap 38 is retained within the cavity 32 by snap ring 36. The snap ring is retained within an annular groove 34, formed in the wall of the cavity 32. When the cover cap 38 is assembled within the cavity 32, it is recessed within the leg 20. Thus, no part of the cover cap extends beyond the surface of the leg 20.

Figure 3:
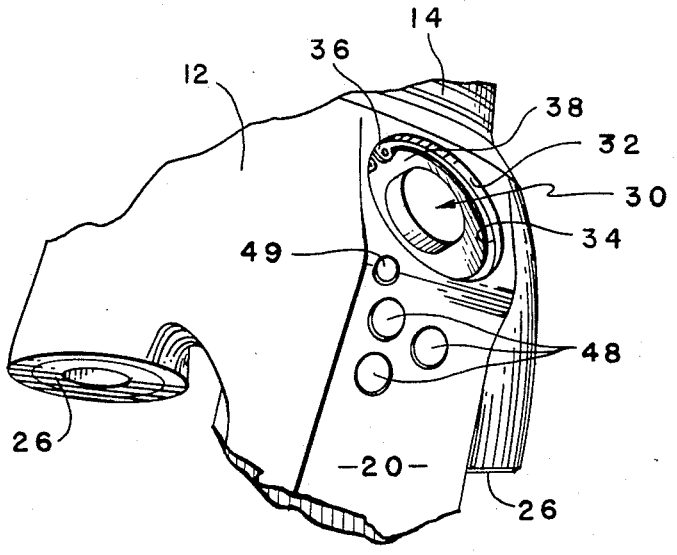
FIG. 3 is a partially cut away view illustrating the position of each of the flush-type inserts interference fitted within sockets drilled in the leg face, the flush-type inserts surrounding the opening to the lubricant reservoir.

During extended drilling operations, the outer surface of the leg 20 may begin to wear away in an area surrounding the reservoir cavity 32. As heretofore stated, the erosive effects of the earth formation adjacent the bit may grind down the leg material around the reservoir 30 to such an extent that the snap ring groove 34 becomes exposed. The resultant exposure could cause the ejection of both the snap ring 36 and the cover cap 38 from the reservoir system, thus destroying the lubricant reservoir system for the rock bit. To protect the cover cap for the reservoir system, a series of flush-type tungsten carbide inserts 48 and 49 (FIG. 3) are strategically positioned around the peripheral edge of the reservoir cavity 32. As illustrated in FIG. 2, a series of drilled insert holes are positioned within the leg 20. Each of the insert holes or sockets are strategically positioned to protect the rim of the reservoir cavity 32 during operation of the drill bit during drilling operations. A smaller hole 45 is drilled toward the upper end of leg 20 to accept, for example, a smaller flush insert 49 (FIG. 3). Three larger holes are drilled in the leg 20, for example, to accept the larger diameter flush inserts 48. Each of the inserts 48 and 49 are interference fitted within their respective insert holes to retain the inserts in the leg 20.

While a specific pattern of flush-type inserts is shown with reference to FIGS. 1, 2 and 3, the size and pattern of the flush-type inserts may be varied depending on the surface area available surrounding the reservoir cavity, the direction the bit turns and the size of the flush-type inserts utilized.

By providing tungsten carbide type flush inserts in the area surrounding the grease reservoir cover cap, it has been proven through actual bit runs in the field that the inserts do indeed protect the reservoir cavity. The inserts prevent the erosion of material surrounding the annular snap ring groove 34 from being destroyed, thus protecting the cover cap and the reservoir system.

With reference now to FIG. 3, each of the inserts 48 and 49 are shown interference fitted within their respective retention holes or cavities 44 and 45 formed by the bit (FIG. 2). With the flush-type tungsten carbide inserts in place, the reservoir system is adequately protected during operation of the rock bit—thus prolonging the life of the bit during rock bit operations.

It would be obvious to provide a layer of hardfacing material to the leg area that surrounds the grease reservoir cover cap. There are many hard-metal applications that could be metallurgically applied to this critical area surrounding the cover cap. However, a specific example would be an acetylene-tube-borium hardfacing material, manufactured by STOODY CO. of the City of Industry, Calif. This material is applied by an acetylene torch directly onto the surface to be hardfaced. Geometric shapes of tungsten carbide material within the acetylene-tube-borium material rises to the surface in an unmelted state and is bound by the mild steel base metal of the alloy, thereby providing an abrasion resistant surface.

It would also be obvious to secure the tungsten carbide inserts by means other than interference fitting each insert within sockets or holes formed by the rock bit leg. For example, the inserts could be brazed within their receptacles (not shown).

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. An apparatus to protect the lubrication system for a sealed bearing rotary cone rock bit which comprises:

a rock bit body having a first pin end and a second cutting end, one or more legs extend from said rock bit body, each leg having a journal bearing nearest said second cutting end, each of said journal bearings having a rotary cutter cone attached thereto, a lubricant reservoir chamber is formed by at least one leg of said rock bit body, the reservoir chamber includes a reservoir cover cap that is retained within an opening to said reservoir chamber formed by the leg of the rock bit, said cover cap is retained within said reservoir opening by a snap ring, said snap ring is retained within a groove formed in said leg adjacent said opening to said reservoir chamber, and means to protect the cover cap for said reservoir chamber to prevent the cover cap from becoming disengaged from the lubricant reservoir chamber in the leg of the rock bit during rock bit drilling operations, said means to protect said cover cap is an application of hardfacing material positioned around the peripheral edge of said opening to said reservoir chamber.

2. The invention as set forth in claim 1 wherein said hardfacing material is acetylene-tube-borium.

3. An apparatus to protect the lubrication system for a sealed bearing rotary cone rock bit which comprises:

a rock bit body having a first pin end and a second cutting end, one or more legs extend from said rock bit body, each leg having a journal bearing nearest said second cutting end, each of said journal bearings having a rotary cutter cone attached thereto, a lubricant reservoir chamber is formed by each leg of said rock bit body, the reservoir chamber includes a reservoir cover cap that is retained within an opening to said reservoir chamber formed by the leg of the rock bit, said cover cap is retained within said reservoir opening by a snap ring, said snap ring is retained within a groove formed in said leg adjacent said opening to said reservoir chamber, and means to protect the cover cap for said reservoir chamber to prevent the cover cap from becoming disengaged from the lubricant reservoir chamber in the leg of the rock bit, said means includes a multiplicity of tungsten carbide flush-type inserts that are interference fitted within sockets formed by said leg, said multiplicity of flush-type tungsten carbide inserts prevent erosion of the material surrounding said cover cap thus protecting said cover cap and reservoir lubrication system during rock bit operations.

* * * * *